United States Patent [19]

Overmyer et al.

[11] 3,999,001

[45] Dec. 21, 1976

[54] ARC FURNACE FUMES CONTROL SYSTEM

[75] Inventors: Robert C. Overmyer; Pramodh Nijhawan, both of Indianapolis, Ind.

[73] Assignee: Hawley Manufacturing Corporation, Indianapolis, Ind.

[22] Filed: Mar. 8, 1976

[21] Appl. No.: 664,947

Related U.S. Application Data

[63] Continuation-in-part of Ser. No. 616,155, Sept. 24, 1975.

[52] U.S. Cl. ..... 13/10

[51] Int. Cl.[2] ..... F27D 17/00

[58] Field of Search ..... 13/9, 10, 33, 1; 98/115 R

[56] References Cited

UNITED STATES PATENTS

| | | | |
|---|---|---|---|
| 2,908,737 | 10/1959 | DeDominicis | 13/10 |
| 3,539,692 | 11/1970 | Heeney | 13/9 |
| 3,876,418 | 4/1975 | Baum | 13/33 X |

*Primary Examiner*—R. N. Envall, Jr.
*Attorney, Agent, or Firm*—Jenkins, Hanley & Coffey

[57] ABSTRACT

An exhaust system for use with an electric arc melting furnace having a crucible and an upwardly directed mouth covered by a roof, and a device coupled to the roof for projecting it upwardly along an axis and pivotally about the axis to a position out of registry with the mouth for providing access for charging the furnace, and a device for tilting the furnace for tapping and slagging. In one embodiment the fumes exhaust system comprises an exhaust fan, a telescoping main fumes exhaust duct flexibly coupled at one end to the exhaust fan, a coupler flexibly connected to the other end of the main fumes exhaust duct and a tapping and melting manifold and hood flexibly and telescopically connected to the coupler. The tapping and melting manifold and hood are connected to the roof and project vertically along the roof axis and pivot about the roof axis with the roof to a position out of registry with the mouth. A slagging manifold and hood are mounted on the furnace and connected to the coupler. The fumes exhaust system includes a charging hood adapted for movement into close, overlying relationship with the furnace mouth when the tapping and melting manifold and hood are withdrawn from registry therewith, the charging hood having an opening in its top through which the charging bucket is lowered, the charging hood being in communication with the slagging manifold when the charging hood is in overlying relationship with the furnace mouth. The charging hood is constructed to provide for air movement past the mouth and into the slagging manifold for exhausting fumes and dust evolved during charging of the furnace into the main fumes exhaust duct. In two other embodiments, the main fumes exhaust duct is coaxial with the tilt axis of the furnace at the point where the furnace exhaust system is coupled to the main fumes exhaust duct. The furnace exhaust system is coupled to the main duct by a swivel which allows the furnace system to remain coupled to the main duct during tapping and slagging. The charging hoods in the two last mentioned embodiments pivot in horizontal planes into and out of their use positions in close overlying relationship to the furnace mouth.

12 Claims, 11 Drawing Figures

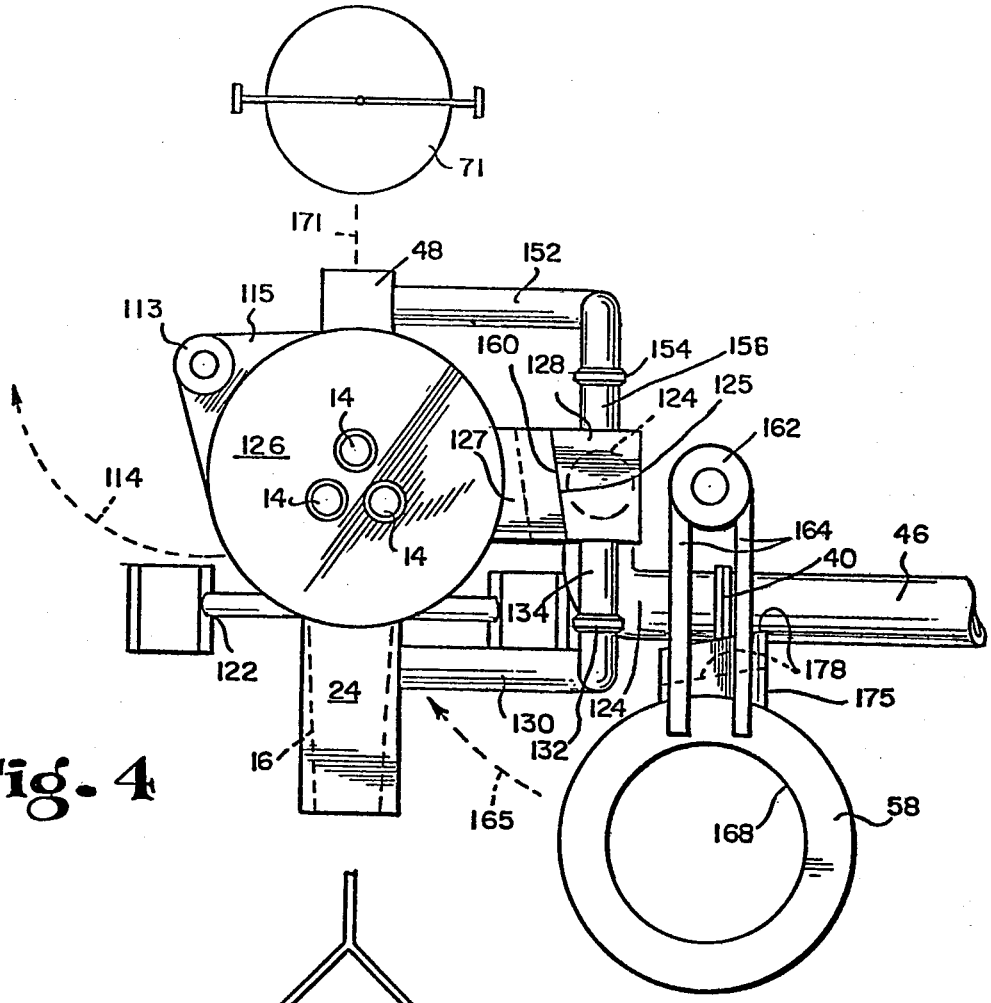
Fig. 4
Fig. 5
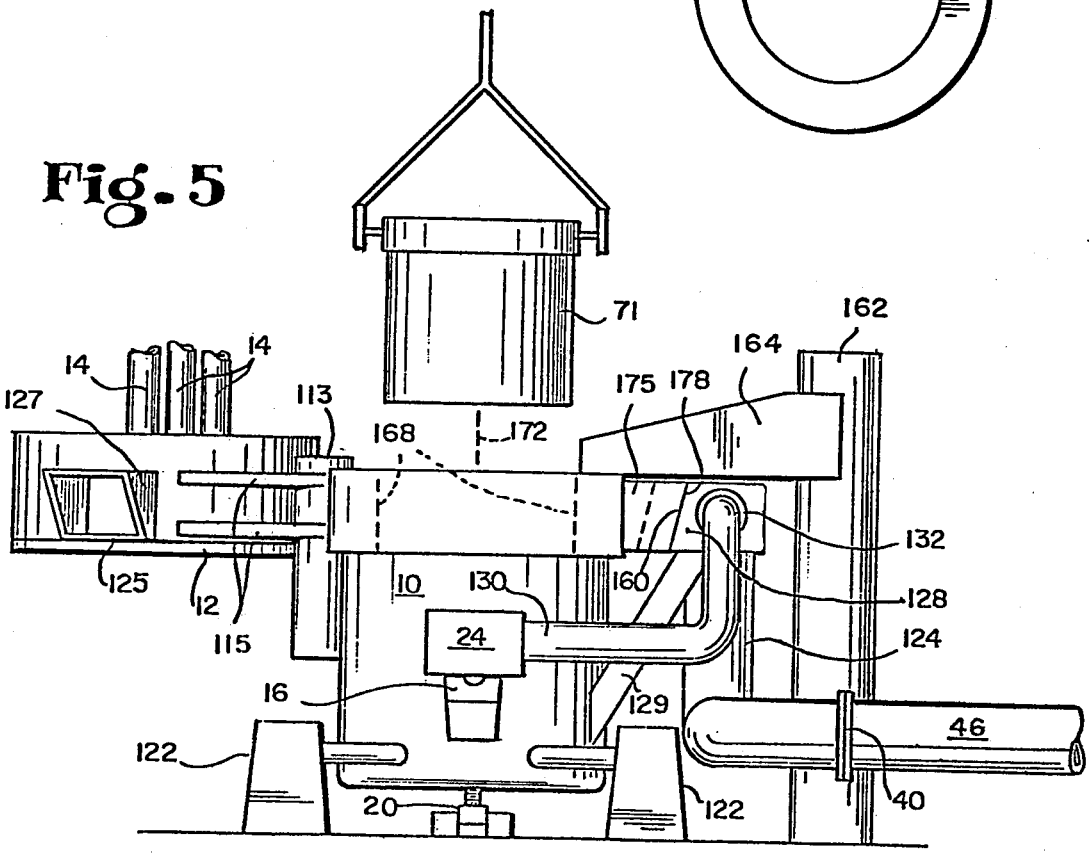

ARC FURNACE FUMES CONTROL SYSTEM

This application is a continuation in part of our copending U.S. patent application Ser. No. 616,155, filed Sept. 24, 1975, titled "Arc Furnace Fumes Control System" and assigned to the same assignee as the present invention.

This invention relates to fumes exhaust systems for electric metal melting furnaces.

In an electric metal melting furnace of the type which comprises a crucible tiltable about one or more axes for tapping and slagging operations and further containing orifices for such operations, the exhausting of fumes generated during charging, tapping, slagging and melting is a problem which has caused great concern for environmental and health reasons. Generally, such furnaces tilt forwardly for tapping and rearwardly for slagging such that the pouring spout extends forwardly and the slagging opening opens rearwardly. Since the top of such a furnace is generally closed by a roof having perforations therethrough through which a plurality of electrodes protrude for providing electrical power to melt metal with which the furnace is charged, it is necessary to provide means closely spaced above the roof to provide the necessary fumes exhaust for the considerable amount of fumes generated during the melting operation.

Examples of systems which are addressed to these problems are U.S. Pat. Nos. 2,268,918 issued to Allen, et al., 3,021,376 issued to Vedder, et al., and 2,908,737 issued to Dominicis. The exhaust system of U.S. Pat. No. 2,908,737, for example, provides two fumes collecting ports closely spaced to the tapping an slagging orifices. Although the ports may remain coupled to the main fumes exhaust ductwork of that patent during melting, tapping and slagging operations, the collecting ports are not integral with the furnace and thus some fumes may escape from the furnace during tapping, slagging and melting operations.

Likewise it may be seen that during the charging operation when the furnace roof is moved out of registry with the mouth of the furnace to allow lowering entry of a charging bucket through the furnace mouth, the collecting ports must also be swung outwardly away from the mouth of the furnace. But, since considerable amounts of dust and fumes may be evolved during the charging operation, it is desirable to have some provision made for exhausting dust and fumes generated during charging of the furnace.

It is thus an object of the present invention to provide an integral fumes exhaust system for an electric metal melting furnace which provides fumes exhaust during tapping, slag discharge, charging, melting and oxygen lancing operations.

Other and further objects of the present invention will become obvious to those skilled in the art to which it pertains as this specification progresses.

In accordance with the present invention, a melting furnace fumes exhaust system is provided for a furnace having a crucible and an upwardly directed mouth covered by a roof adapted for being projected vertically upwardly along an axis and pivotally about the axis to a position out of registry with the mouth for providing access for charging the furnace, which furnace is tiltable for tapping and slagging. The fumes exhaust system comprises an exhaust fan or blower, a main fumes exhaust duct coupled at one end to the exhaust fan, a coupler flexibly connected to the other end of the main fumes exhaust duct and a melting manifold and hood. The melting manifold and hood move with the roof to a position out of registry with the mouth. Tapping and slagging hoods are mounted on the furnace over the tapping spout and slagging opening, respectively, and are connected to the main fumes exhaust duct, the flexing action of the main duct allowing the tapping and slagging hoods to remain connected thereto for withdrawal of fumes generated by tapping and slagging when the furnace is tilted forwardly and rearwardly, respectively. A charging hood is adapted for movement into close, overlying relationship with the mouth when the roof and melting hood are withdrawn from registry therewith. The charging hood has an orifice in its top through which the charging bucket is lowered and means for coupling the charging hood to the main fumes exhaust duct when the charging hood is in overlying relationship with the mouth. The charging hood further comprises means for allowing air to be drawn therethrough, past the mouth, and into the main fumes exhaust duct for exhausting fumes and dust evolved during charging of the furnace.

As used herein, "flexible" means capable of being moved or changed in direction or orientation without breaking, i.e., not stiff. "Flexible" is thus meant to include "swivelling", "pivoting" and "telescoping", etc.

The invention may best be understood by reference to the following description and accompanying drawings of which:

FIGS. 4–5 are diagrammatic top and front elevations, respectively, of a furnace incorporating an alternative embodiment of the invention, some of the dashed lines of which partially illustrate movement of exhaust ducts, hoods and manifolds during various furnace operations;

Figure 1:
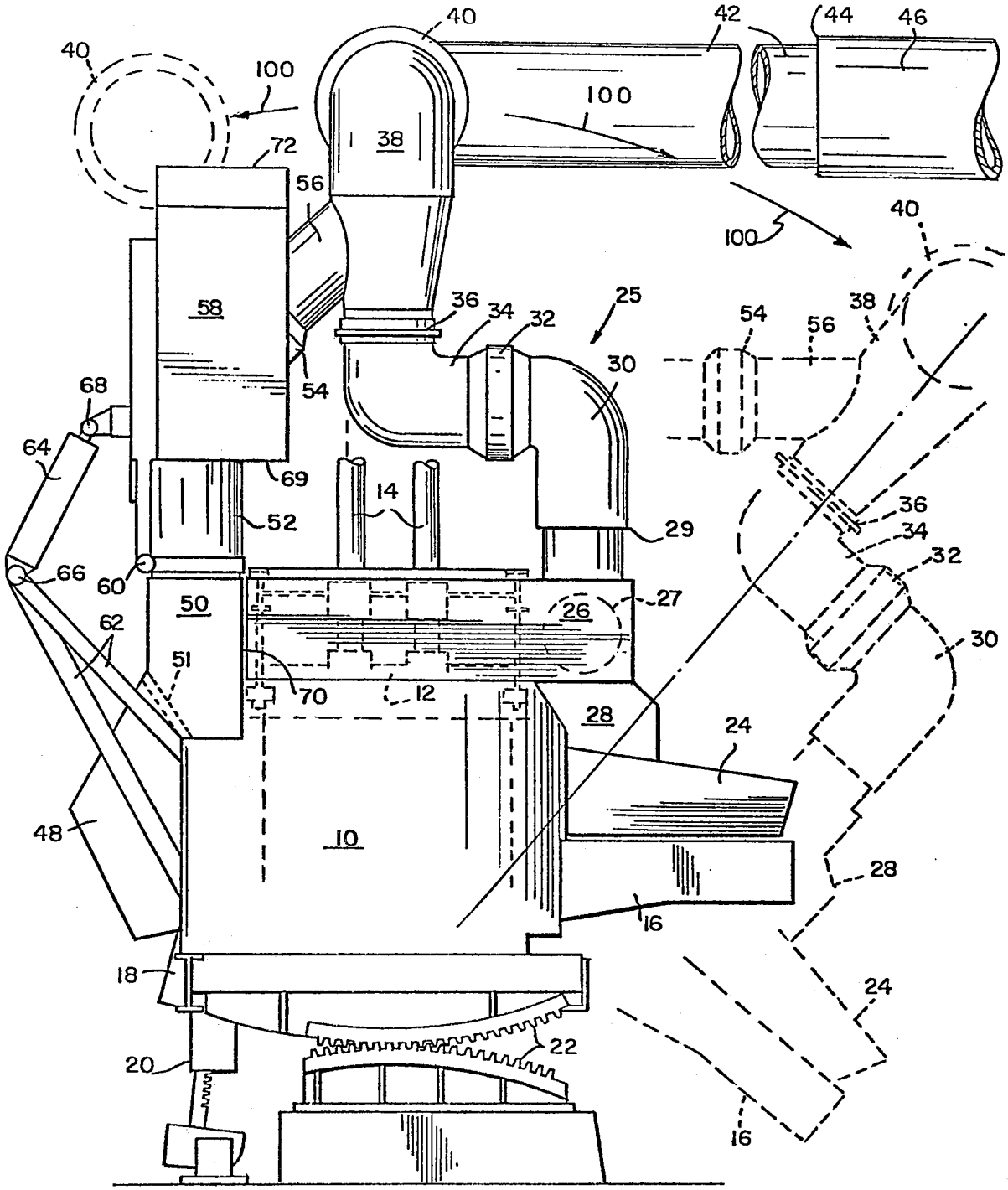
FIG. 1 illustrates a side view of a furnace and fumes exhaust system constructed in accordance with the invention, some of the dashed lines of which partially illustrate positions of the exhaust ducts, hoods and manifolds when the furnace is tilted for slag discharge or tapping of the furnace for removal of product therefrom.
Figure 2:
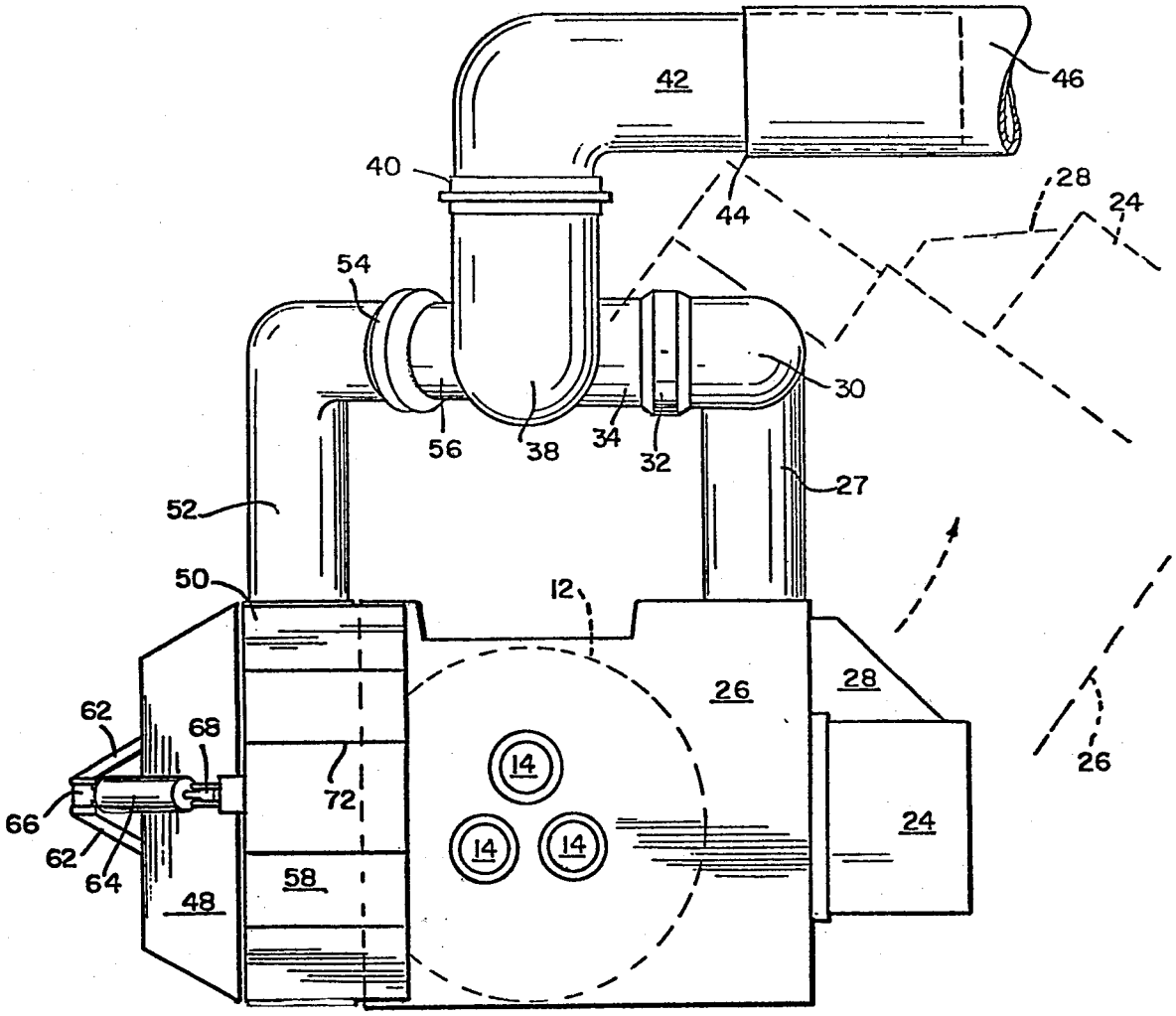
FIG. 2 illustrates a partial top view of the furnace and fumes exhaust system of FIG. 1, some of the dashed lines of which partially illustrate positions of exhaust ducts, hoods and manifolds when the roof is moved out of registry with the furnace mouth for charging.
Figure 3:
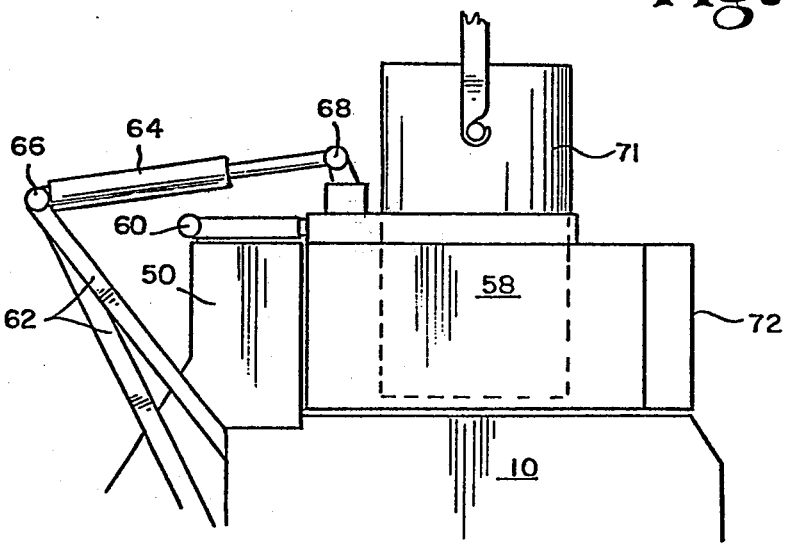
FIG. 3 illustrates a side view of a detail of the furnace and fumes exhaust system as shown in FIG. 1 and including a charging bucket.

In the furnace and fumes exhaust system illustrated in FIGS. 1–3, a crucible 10 of an electric arc furnace for melting metal has an upwardly directed mouth covered during melting operations by a roof 12. A plurality of electrodes 14 which supply electricity for melting of metal in the furnace protrude vertically through perforations in roof 12. Roof 12 is conventionally adapted for removal from the furnace mouth by projecting vertically upwardly a short distance and then transversely out of registry with the mouth by a conventional lifting and pivot mechanism (not shown).

Crucible 10 also has a spout 16 communicating through the side wall thereof through which molten metal flows when the furnace is tilted forwardly to the position indicated by dashed lines and arrows 100 of FIG. 1 for tapping. When the furnace is tilted rearwardly for slag discharge, slag flows from the crucible 10 outwardly through an orifice in the side wall thereof and through slagging door 18. The furnace is conventionally tilted by a tilting mechanism 20 upon rocker gears 22.

Coupled in overlying relationship with spout 16 is a fumes exhaust hood 24 for collecting fumes generated as molten metal pours from said spout as the furnace is tapped. A combined tapping and melting fumes exhaust manifold and hood 26 through which pass fumes generated during the melting cycle, as well as those generated during tapping, overlies furnace roof 12 and extends into the region of the roof adjacent the protruding electrodes 14. Since considerable amounts of fumes are evolved in the region of the electrodes during the melting cycle, it is advantageous to have hood 26 extend as far into the region of the electrodes as possible and to have openings therein proximate the perforations in the roof 12 through which electrodes 14 extend for collecting fumes generated during the melting cycle. As it may thus be advantageous for hood 26 to surround electrodes 14 as shown in FIG. 2, hood 26 is made to be lifted slightly and pivoted with roof 12 as roof 12 moves to a position out of registry with the furnace mouth.

Tapping fumes exhaust hood 24 and tapping and melting fumes exhaust manifold and hood 26 are connected together by a duct section 28. Hood 24 and hood and manifold 26 are coupled through a section of conduit 25 which includes a first vertically rising right angle bend 27, a sliding, i.e., telescoping, joint 29, a second right angle bend 30, a selectively variable damper 32, a vertically rising right angle bend 34, a swivel joint 36 which has a vertically extending swivel axis coinciding with the pivot axis of roof 12 in the solid position of FIG. 1, a larger right angle bend section 38 and a swivel joint 40 connecting to a main fumes exhaust duct having a right angle bend section 42 which fits telescopingly at joint 44 into a main fumes exhaust duct section 46 which is coupled at its other end to exhaust fan means (not shown). The swivel joint 40 has a horizontal swivel axis which intersects the vertical axis of the swivel joint 36.

Overlying slag discharge door 18 is a slagging fumes exhaust hood 48. Hood 48 is coupled to a slagging fumes exhaust manifold 50. A damper 51 may be used to dampen off the slagging hood 48 as necessary. From manifold 50, fumes are conducted through a duct section 52, a selectively controllable damper 54 and a short duct section 56 into duct section 38 and thence into the main fumes exhaust duct.

The dampers 32 and 54 are provided for selectively varying the amount of air flow through respectively the tapping and melting manifold and the slagging manifold as the furnace operations change.

Swivel joint 40, telescoping joint 44 and an additional right angle bend and swivel joint (not shown) at the point where duct section 46 is connected to the exhaust fan means allow the end of the main duct which is connected to the furnace duct system at swivel 40 to elevate, extend and contract as the arrows 100 and dashed lines in FIG. 1 illustrate. Thus, the tapping and melting fumes exhaust hood and manifold 26 and the slagging hood 48 remain connected to the main fumes exhaust hood during tapping and slag discharge operations.

The face 70 of slagging fumes exhaust manifold 50 abutting tapping and melting hood and manifold 26 has one or more openings thereon which are sealed by the abutting face of hood and manifold 26 when hood and manifold 26 is in the position shown in solid lines in FIG. 1 for the melting and tapping phases of furnace operation. To prepare the furnace for charging, however, furnace roof 12 and tapping hood 24 and melting and tapping manifold and hood 26 are projected vertically upwardly a slight amount and moved to a position out of registry with the mouth of the furnace exposing the openings in the aforementioned face of slagging manifold 50. A charging hood 58 which is supported by hinged connection 60 from the top of manifold 50 is projected downwardly into overlying relationship with the top of crucible 10.

The lowering and raising apparatus for hood 58 comprises a plurality of charging hood supports 62 attached to the back of crucible 10 and a controllable hydraulic cylinder 64 pivotally connected to supports 62 at joint 66 and to hood 58 at joint 68.

The rearward face 69 of hood 58, which abuts the forward face 70 of slagging manifold 50 when hood 58 is in its lowered, charging position, has one or more openings therein which register with the openings in the abutting face 70, thereby connecting charging hood 58 to the main fumes exhaust system. Hood 58 also has a central circular aperture through the top face thereof in registry with the furnace mouth to allow passage of a charging bucket 71 therethrough for charging the furnace. As the bottom of charging bucket 71 opens to dump the metal charge into the furnace, dust and fumes evolved thereby are swept into the fumes exhaust system by air passing through an opening 72 in the front face of charging hood 58.

An additional advantage of the fumes exhaust system thus presented is that the system leaves open the operating side of the arc melting furnace, the operating side being that side illustrated in FIG. 1.

This fumes control system thus provides for immediate or close capture of fumes and dust arising during furnace operation. Fumes evolved during tapping of the furnace are drawn from spout 16 into the closely overlying exhaust hood 24, through connecting duct 28 and manifold and hood 26 and then through the connecting ductwork 25 into the main fumes exhaust duct 42, 44, 46.

Similarly, fumes evolved during melting operations are swept from the vicinity of the roof 12 perforations through which electrodes 14 pass by air flowing under manifold and hood 26. The captured melting fumes are then conducted through ductwork 25 into the main fumes exhaust duct.

Fumes released during the slagging operation from slagging door 18 are drawn immediately upwardly into closely overlying slagging exhaust hood 48 and then into exhaust manifold 50 to be conducted away through ductwork 52, 54, 56, 38 and 40 into the main fumes exhaust duct.

When roof 12 and manifold and hood 26 and tapping hood 24 are moved away from the furnace and charging hood 58 is moved into closely overlying relationship therewith for charging, air drawn between hood 58 and crucible 10 immediately sweeps dust and fumes created through mating passageways in rearward surface 69 and forward surface 70. The fumes and dust are conducted through ductwork 52, 54, 56 38 and 40 into the main fumes exhaust system.

Referring now to the furnace fumes exhaust control system illustrated in FIGS. 4–5, those elements which are numbered identically with the elements presented in the preceding discussion of the exhaust control system of FIGS. 1–3 perform the same or similar functions. In FIGS. 4–5, crucible 10 of the electric arc furnace has an upwardly directed mouth covered during melting operations by roof 12, a tapping spout 16 covered by a tapping fumes exhaust hood 24, and a slag door (not shown) covered by a slagging fumes exhaust hood 48.

A plurality of electrodes 14 supply electricity for melting metal in the furnace, electrodes 14 protruding through roof 12 into the interior of the furnace. Roof 12 in this embodiment is adapted for removal from the furnace mouth by a member 113 which member is mounted upon the side of crucible 10. Member 113 projects roof 12 vertically upwardly and then moves roof 12 transaxialy to a position out of registry with the furnace mouth by pivoting it about the central axis of member 113 along dotted line 114. Roof 12 is attached to pivot member 113 by a plurality of support members 115.

Attached to roof 12 is a melting fumes exhaust hood 126. Provision is made in the top of hood 126 for electrodes 14 and an exhaust duct 127 opens interiorly of hood 126. At the end of exhaust duct 127 remote from hood 126 is a mating flange 125.

In the furnace of this embodiment, crucible 10 is mounted upon a pair of trunnions 122, the crucible being tilted by a conventional tilting mechanism 20. In this embodiment of the invention, duct section 46, the other end of which is connected to the exhaust fan means (not shown) is coaxial with the tilt axis of crucible 10, i.e., the pivotal axes of trunnions 122. Attached to duct section 46 by swivel 40 is a main fumes exhaust duct 124 which first executes a right angle bend to run rearwardly of crucible 10 from swivel 40 and then executes a second right angle bend to run vertically upwardly, terminating in a main fumes exhaust manifold 128. Main fumes exhaust manifold 128 is mounted upon the side of crucible 10 by one or more diagonal support members 129.

Tapping fumes exhaust manifold 24, which overlies tapping spout 16, is connected to main fumes exhaust manifold 128 by a duct section 130, a controllable damper 132 and a duct section 134. Slagging fumes exhaust hood 48 is attached to main fumes exhaust manifold 128 by a duct section 152, a controllable damper 54 and a duct section 156. Dampers 132 and 154 are controllable to vary their rates of withdrawal of fumes from tapping fumes exhaust hood 24 and slagging fumes exhaust hood 48, respectively.

A mating surface 160 is provided along the side of main fumes exhaust manifold 128 which opens toward crucible 10.

The charging hood 58 of the embodiment of FIGS. 4–5 is attached to a floor mounted member 162 by a plurality of supporting arms 164 for projecting vertically upwardly and downwardly along the axis of member 162 and for pivoting about said axis into a position in registry with the mouth of crucible 10 as indicated by line 165 of FIG. 4 for charging the furnace. The central opening 168 in charging hood 58 is provided for entry of the charging bucket 71 into the furnace for charging purposes as indicated by dashed lines 171, 172. Along the outer periphery of charging hood 58 is a fumes exhaust duct 175 terminating in a mating surface 178 similar to the mating surface 125 on fumes exhaust duct 127 of melting hood 126. Mating surfaces 125, 178 are proportioned and designed sealingly to engage mating surface 160 when roof 12 and charging hood 58, respectively, are moved into engagement with the furnace mouth.

During the charging operation, when charging hood 58 engages the mouth of crucible 10, the charging bucket 71 is lowered into opening 158, fumes are withdrawn from the interior of the furnace and flow through duct 175, past the junction of mating surfaces 160 and 178, into the main fumes exhaust manifold 128, through main fumes duct 124 and into duct 46.

After charging is completed, charging hood 58 is moved transaxially to a position out of registry with the mouth of crucible 10 along dotted line 165 to its storage position illustrated in FIG. 4. In some cases it may be desirable to raise and lower the charging hood 58 along the axis of member 162 in order to place the charging hood in a use position close to the crucible 10. The roof 12 and melting fumes exhaust hood 126 with its exhaust duct 127 are pivoted about the axis of member 113 along dotted line 114 into a position in registry with the mouth of crucible 10 and projected vertically downwardly along the axis of member 113 to close crucible 10. With the elements of the furnace and fumes control system in this position, mating surfaces 125 and 160 are engaging. As melting begins, fumes from the melting operation are withdrawn from the furnace through hood 126, duct 127, past the junction of surfaces 125, 160, and through main fumes exhaust manifold 128, main fumes exhaust duct 124 and duct 46.

As in the preceding embodiment, fumes evolved during the tapping operations are captured under tapping fumes exhaust hood 24 and are carried away through duct sections 130 and 134 into the main fumes exhaust manifold 128. Similarly, fumes evolved during the slagging operation are captured under slagging fumes exhaust hood 48 and are swept away through duct sections 152 and 156 into the main fumes exhaust manifold 128. Of course, conduction of fumes from either tapping fumes exhaust hood 24 or slagging fumes exhaust hood 48 may be inhibited by closing dampers 132, 154, respectively.

Referring now to the furnace fumes exhaust control system illustrated in FIGS. 6–9, those elements which are numbered identically with the elements presented in the preceeding discussion of the systems of FIGS. 1–3 and 4–5 perform the same or similar functions.

The distinguishing features of the third embodiment include the generally columnar layout of the fumes exhaust system and the supporting attachment of the charging hood 58 to the exhaust system column. As will be explained, these features allow the charging hood to be attached directly to the crucible, as in the embodiment of FIGS. 1–3, while allowing the charging hood to be moved into and out of registry with the furnace mouth by pivotal motion only. Thus, the embodiment of FIGS. 6–9 provides for simple pivotal movement of the charging hood 58 from its storage position away from the furnace to its use position in overlying relationship with the furnace mouth.

Figure 6:
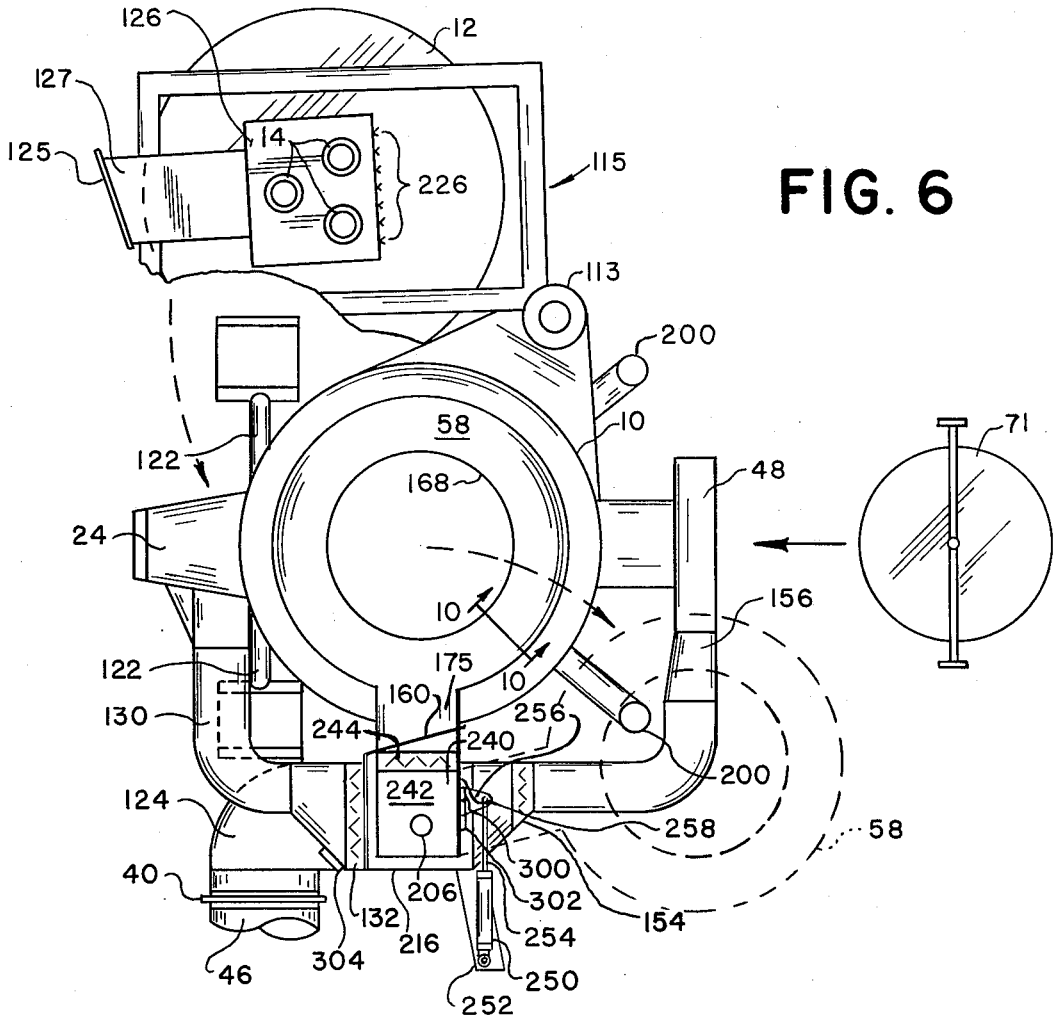
FIG. 6 is a diagrammatic top elevational view of a furnace incorporating another alternative embodiment of the invention, some of the dashed lines of which partially illustrate movement of exhaust ducts, hoods and manifolds during various furnace operations.

In the third embodiment, a plurality of electrodes 14 protrude through roof 12 into the interior of the furnace. Roof 12 in this embodiment is moved into and out of engagement with the furnace mouth by a member 113 mounted on the side of crucible 10. Member 113 projects the roof 12 vertically upwardly and then pivots the roof to a position out of registry with the furnace mouth as indicated in FIG. 6. Frame members 115 attached to pivot member 113 are adapted to lift roof 12 by one or more lifting means, e.g., winches or chain hoists (not shown), mounted on frame members 115 and selectively engageable with roof 12. A melting fumes exhaust hood 126 is also attached to frame 115 and is supported thereby in close overlying relationship with the perforations in roof 12 through which electrodes 14 protrude. Hood 126 includes openings 226 covered by manually adjustable vanes. In use, air is drawn through openings 226 to sweep away fumes and gas generated during the melting cycle. An exhaust duct 127 opens interiorly of hood 126. At the end of exhaust duct 127 remote from hood 126 is a mating flange 125.

Figure 7:
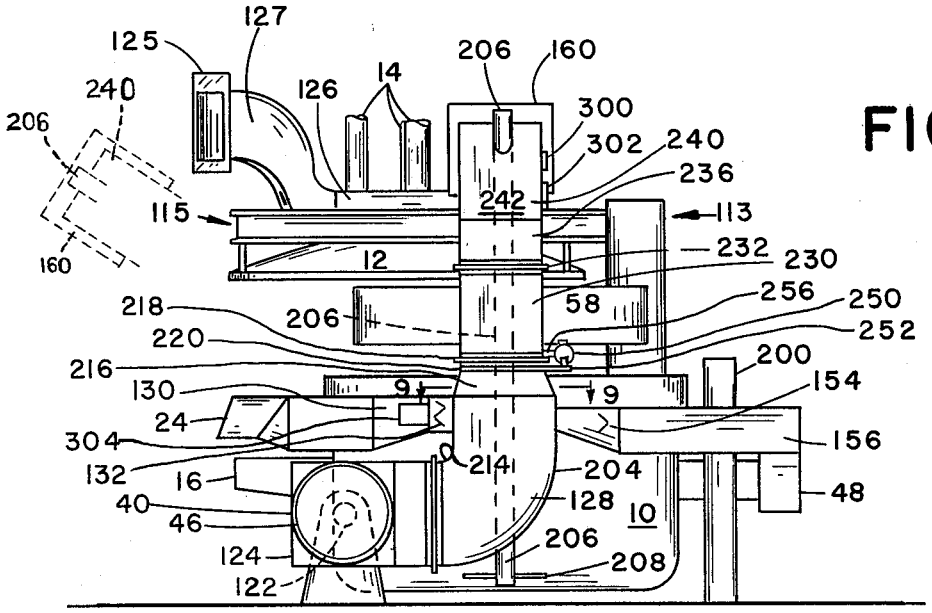
FIG. 7 is a diagrammatic side elevation of the furnace of FIG. 6, some of the dashed lines of which partially illustrate movement of exhaust ducts, hoods and manifolds during various furnace operations.

As in the second embodiment, crucible 10 is mounted upon a pair of trunnions 122. Crucible 10 is tilted by a pair of tilt cylinders 200, located to the rear of, and on each side of, crucible 10. The main fumes exhaust duct section 46 is coaxial with the tilt axis of crucible 10. Duct section 46 is attached by a duct swivel 40 to a rearwardly running main fumes exhaust duct section 124. Duct section 124 joins a main fumes exhaust duct section 128 which executes a rising right angle bend about half way along the side of the crucible as illustrated in FIG. 7. A support post 206 passes through a downwardly and rearwardly facing side wall 204 of duct section 128.

Support post 206 is attached at its lower extremity by a gusseted support member 208 to the side wall of crucible 10. Upwardly from its lower extremity, support post 206 is attached to the side wall of crucible 10 by a support member 210 which extends through a side wall 212 of duct section 128.

Near the upper extremity of duct section 128, openings are provided in side wall 204 and in an opposite side wall 214 thereof. A tapping fumes exhaust manifold 24, which overlies tapping spout 16 of the crucible 10 is connected to duct section 128 by a duct section 130 and a controllable damper 132. Damper 132 allows air flow into tapping manifold 24 to be regulated or shut off entirely, e.g., when the furnace is not being tapped.

A slagging fumes exhaust hood 48 is attached to main fumes exhaust manifold duct section 128 through the rearwardly facing opening in duct side wall 204 by a controllable damper 154 and a duct section 156. Damper 154 is controllable to vary the rate of withdrawal of the fumes from slagging fumes exhaust hood 48.

Upwardly from dampers 132, 154 duct section 128 is connected to a reducer duct section 216 which reduces the exhaust system cross sectional area slightly and changes the cross sectional shape from rectangular to circular. A swivel 218 is mounted on the upper lip 220 of reducer section 216. A duct section 230 which comprises a charging fumes exhaust manifold is mounted on swivel 218. A swivel 232 is mounted on the upper extremity of duct section 230.

Figure 9:
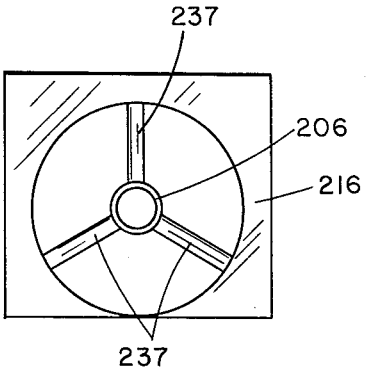
FIG. 9 is a sectional view of a detail of the duct structure of FIGS. 6–8 taken along section lines 9—9 of FIG. 7.

Above swivel 232 is another reducer duct section 236 which reduces the cross sectional area of the duct system and changes its cross sectional shape from circular to rectangular. Duct section 230, and the charging hood 58 which it supports, are supported from post 206 by a plurality of radially extending braces 237 which are connected between the interior side walls of both of reducer sections 216, 236 and the exterior side wall of support post 206. An illustrative layout of braces 237 is shown in FIG. 9, a sectional view of reducer section 216 taken along section lines 9—9 of FIG. 7. A right angle bend duct section 240 is mounted on top of reducer section 236. The upper extremity of support post 206 extends through a side wall 242 of duct section 240. A damper 244 regulates the air flow through duct section 240. Duct section 240 is terminated by a mating flange 160 which opens toward crucible 10 and mates with the flange 125 on melting fumes exhaust manifold 127 when frame 115 is in position over roof 12 and roof 12 is in its use position, closing crucible 10.

Figure 10:
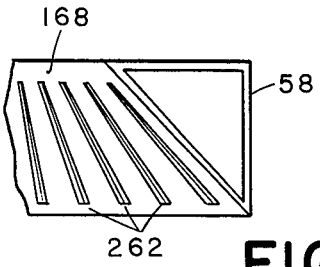
FIG. 10 is a fragmentary sectional view of the duct structure of FIGS. 6–8 taken along section lines 10—10 of FIG. 7.
Figure 8:
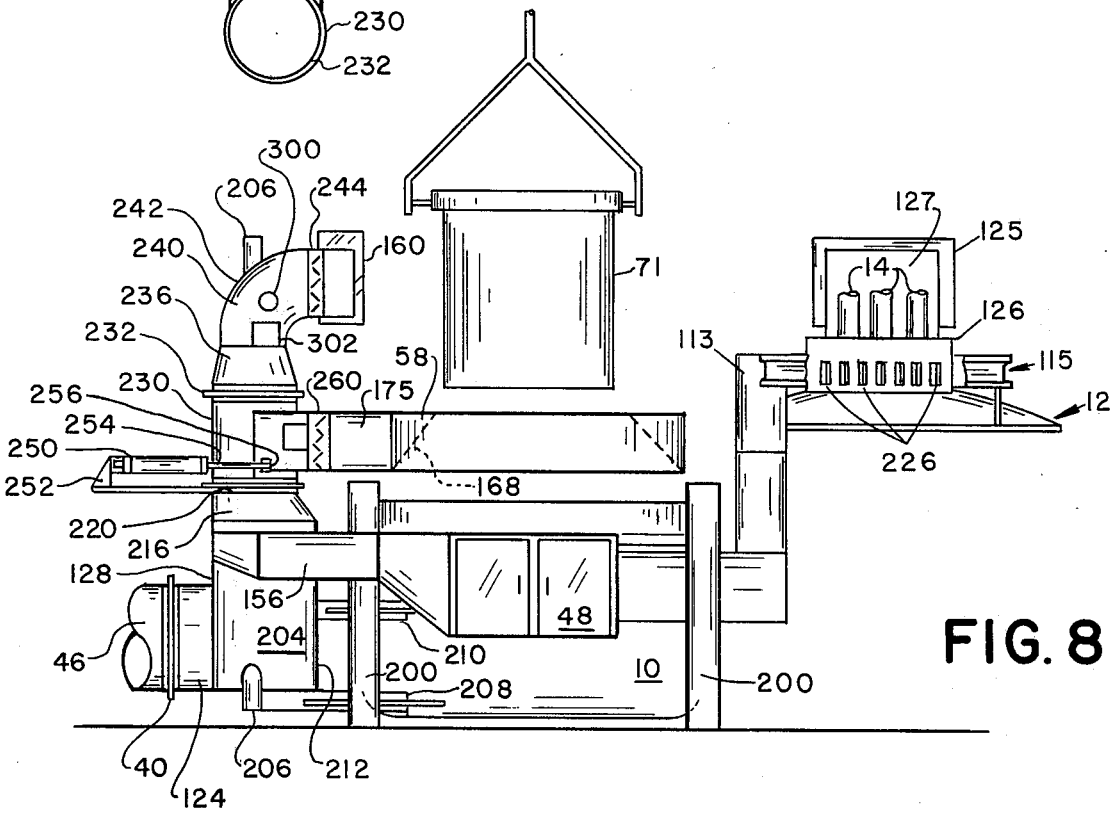
FIG. 8 is a diagrammatic rear elevation of the furnace of FIGS. 6–7.

A charging hood operating cylinder 250 is mounted on a bracket 252 which extends outwardly from the columnar fumes exhaust system away from crucible 10. An operating rod 254 extends from the end of cylinder 250 facing crucible 10 and is attached to a bracket 256 on an outer side wall 258 of a charging hood fumes exhaust duct 175. Duct 175 contains a damper 260 near its end adjacent duct section 230. In this embodiment, radially extending cross sections of charging hood 58 are triangular, with the central opening 168 being defined by an inwardly and downwardly facing surface. Such a radial cross section is illustrated in FIG. 10. Duct section 175 conducts fumes from a plurality of inwardly and downwardly facing radially extending slots 262 on the surface defining central opening 168. The rate of flow of fumes and gas through slots 262 and into duct section 230 is controlled by damper 260.

Figure 11:
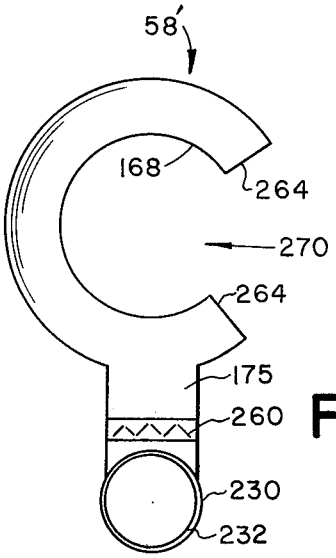
FIG. 11 is a diagrammatic top plan view of an alternative embodiment of a detail of the exhaust system of FIGS. 6–10.

Charging hood 58 of the third embodiment is generally circular as in the second embodiment. Opening 168 allows a charging bucket 71 to drop its contents into crucible 10 when hood 58 is in registry with the furnace mouth. In certain situations, however, it may be desirable to manufacture charging hood 58 with a section removed, the opening in the charging hood thereby defining an arc. Of course, the ends of the arc would be closed to prevent air from entering through them. Thus, there is indicated in FIG. 11 an open sector 270 provided between two ends 264 of an arcuately shaped charging hood 58′. Open sector 270 allows a charging bucket 71 to pass into and out of opening 168 without requiring bucket 71 to be lifted above the level of charging hood 58′. This feature is important in situations in which there is relatively low vertical clearance between the charging hood 58′ and the roof or ceiling of the building in which the furnace is located.

When the furnace of FIGS. 6–9 has been charged, swivels 218, 232 allow charging hood 58 to be pivoted rearwardly of the furnace about the axis of support post 206 by cylinder 250. With the charging hood 58 thus moved out of registry with the furnace mouth, frame 115 and melting hood 126 can be pivoted about the axis of member 113, moving roof 12 into position to close the furnace for the melting operation. As roof 12 is moved into its position in registry with the furnace mouth, flanges 125, 160 seal against one another to provide the necessary connection of melting hood 126 to the main fumes exhaust manifold 128.

As can be seen from the broken line diagram in FIG. 7, in the third embodiment, the entire duct system, including charging hood 58, tilts with the crucible for tapping. The columnar duct system is supported from crucible 10 by support post 206 with duct sections 128, 216, 236 and 240 being mounted directly to the post. Charging hood 58 is supported by duct section 230 which is supported between swivels 218, 232 to allow charging hood 58 to rotate to and from its use position.

The inclusion of a plurality of dampers, e.g., dampers 132, 154, 260, of the third embodiment provides an added benefit to the arc furnace fumes exhaust systems of the present invention. As illustrated in the third embodiment, temperature sensing means comprising a thermometer are mounted near the melting fumes exhaust hood 126, e.g., in duct section 240. Thermometer 300 measures the temperature of the fumes collected by melting hood 126. This thermometer is connected by conventional electrical and/or mechanical control means 302 to an automatic control 304 mounted on one of the dampers 132, 154, 260. In practice, it is of extreme importance to insure that the filtering material through which fumes collected by the fumes control systems of this invention pass is not heated beyond a predetermined temperature. Heating beyond such temperature may, for example, cause the filtering material to begin to burn, destroying its effectiveness as a filter. Thus, if thermometer 300 senses that an excessive temperature has been reached by the melting fumes being conducted through the exhaust system, the apparatus 302, 304 opens one or more of dampers 132, 154, 260, allowing cooler make-up air to enter the exhaust system through the tapping fumes exhaust hood 24, the slagging fumes exhaust hood 48, and the charging fumes exhaust hood 58, respectively. The damper providing the cooler make-up air which lowers the temperature of the exhaust flowing into the filtering equipment remains open until the melting fumes exhaust temperature indicated by thermometer 300 is reduced to a safe level. The filtering equipment, such as a bag house in which are suspended a plurality of bags through which the exhaust fumes flow, and which collect particulate matter from the fumes, is thereby protected from the effects of excessive fume temperature.

As can be seen from the preceding examples, the hood or manifold with which the charging hood is interchangeable may be used exclusively to capture fumes generated during the melting operation, as is the case in the embodiments presented in FIGS. 4–5 and 6–9 or it may be connected to one or more other fumes exhaust hoods, e.g., the tapping fumes exhaust hood, as is the case in the embodiment of FIGS. 1–3. Similarly, the fumes exhaust hood or manifold with which the charging hood is interchangeable can have one or more connecting flanges which allow it to be coupled to one or more other elements in the fumes exhaust control system. As exemplified by the three disclosed embodiments, the fumes exhaust control system can be flexibly coupled to the exhaust fan means by tailoring the connecting duct work to the specific requirements of a particular furnace. See, for example, the distinct arrangements of swivel 40 and duct elements 42–46 of the embodiment of FIGS. 1–3 and swivel 40 and duct 46 of the embodiments of FIGS. 4–5 and 6–9.

Further, as the disclosed embodiments illustrate, the charging hood itself may be mounted upon the furnace as in the embodiments of FIGS. 1–3 and 6–9, or, alternatively, it may be mounted upon an independent base, e.g., support member 162 of FIGS. 4–5. Additionally, as the disclosed embodiments illustrate, the charging hood may be moved into and out of engagement with the furnace mouth by a linear actuator such as hydraulic cylinders 64, 250 of the embodiments of FIGS. 1–3, 6–9, respectively, or by rotary actuator such as the pivotal member 162 of the embodiments of FIGS. 4–5. Of course, the actuator could be regulated by any desired means, e.g., pneumatic, hydraulic or electrical.

It may be seen that the disclosed "close capture" fumes control systems provide apparatus for immediately capturing any fumes or dust generated during any phase of operation of the arc furnace. All fumes and dust are thus prevented from escaping and may be conducted away through the main fumes exhaust system to a point where solids and harmful and deleterious gaseous pollutants may be separated from the effluent fumes before final exhaustion of the gas into the environment. An additional and significant advantage of close capture arrangements of the type herein presented is that considerably less air volume is required to insure complete withdrawal of fumes and dust from the furnace into the exhaust system. The significant decrease in air volume required results in important economies in exhaust fan capacity, ductwork capacity and filtering equipment (baghouse) capacity. Capturing the fumes by these close capture hoods also ensures that the fumes and dust from the electric arc furnace do not contaminate the breathing air of the operators who may be working in the area.

What is claimed is:

1. In a fumes control system for an electric arc furnace comprising a crucible providing an upwardly directed mouth, a roof covering said mouth, said roof being movable into an opening position away from said mouth, a plurality of arc electrodes extending downwardly through said roof, said crucible having at least one pouring spout opening therein and being tiltable for tapping, said control system comprising exhaust means, first hood means for collecting fumes generated during furnace operations from said roof, said first hood means being movable with said roof to expose said mouth, the improvement comprising charging hood means for movement into a use position in close overlying relationship with said mouth when said first hood means and said roof are moved away from said mouth, said charging hood means having an opening therein through which said crucible is charged, said charging hood means also having a storage position away from said mouth, a columnar exhaust duct, means for supporting said columnar exhaust duct upon said crucible, said columnar exhaust duct comprising upper, intermediate and lower portions, said exhaust means being flexibly attached to said lower portion to allow said exhaust duct to tilt with said crucible, first conduit means for coupling said first hood means to said upper portion when said roof is covering said mouth, said intermediate portion including means for supporting said charging hood means from said columnar exhaust duct for movement between said storage and use positions and for coupling said charging hood means to said exhaust duct when said charging hood means is in said use position.

2. A fumes control system according to claim 1 wherein said crucible has a pouring spout opening forwardly and a slagging port opening rearwardly, said crucible being tiltable forwardly to pour through said spout and rearwardly for removing slag from said port, third hood means for collecting fumes from said pouring spout, third conduit means for connecting said third hood means to said lower portion of said exhaust duct, fourth hood means for collecting fumes from said slagging opening, fourth conduit means for connecting said fourth hood means to said lower portion of said exhaust duct, said third and fourth hood means being mounted on said crucible for tilting movement therewith.

3. A fumes control system according to claim 1 wherein said means for supporting said columnar exhaust duct comprises a support post mounted on said crucible and extending generally vertically, said columnar exhaust duct being attached to said support post, said intermediate portion including a pair of swivels having a duct section therebetween, said charging hood means being attached to said duct section for movement between said storage and use positions.

4. A fumes control system according to claim 3 wherein said opening in said charging hood means is generally circular for allowing a charging bucket to enter said crucible therethrough when said charging hood means is in said use position.

5. A fumes control system according to claim 3 wherein said charging hood means opening is generally arcuate, said charging hood means further defining an open sector for allowing a charging bucket to enter said opening by moving horizontally through said open sector.

6. A fumes control system according to claim 1 and further comprising means for sensing the temperature of fumes in said upper portion of said columnar exhaust duct, said sensing means being connected to said upper portion, a controlled damper coupled to said exhaust means and to a source of cooling make-up air, and damper control means connected to said temperature sensing means and to said controlled damper for opening said damper in response to sensing of fume temperature above a predetermined maximum in said upper portion.

7. In a fumes exhaust system for use with a furnace having a crucible with an upwardly directed mouth, a roof for covering said mouth during melting operations in said furnace, and means for projecting said roof vertically upwardly along an axis and pivotally about said axis to a position out of registry with said mouth for providing access thereto for charging said furnace, means for tilting said furnace for tapping, said fumes exhaust system comprising exhaust means and first hood means movable with said roof to a position out of registry with said mouth, the improvement comprising charging hood means movable between a use position in close overlying relationship with said mouth when said roof is moved to a position out of registry with said mouth and a storage position remote from mouth, said charging hood means having a top with an opening therein for passage of a charging bucket therethrough when said charging hood means is in overlying relationship with said mouth, said charging hood means having means therein disposed to provide air movement past said mouth, and into said exhaust means for exhausting fumes and dust generated during charging of said furnace, a columnar exhaust duct, means for supporting said columnar duct upon said crucible for tilting movement therewith, said columnar duct having upper, intermediate and lower portions, means for flexibly coupling said lower portion to said exhaust means to allow said tilting movement of said columnar duct, said upper portion including means for engaging said first hood means when said roof is covering said crucible for connecting said first hood means to said columnar duct for withdrawing fumes generated during said melting operations, and said intermediate portion including means for flexibly coupling said charging hood means to said columnar duct to allow said charging hood means to move between said storage and use positions.

8. A fumes exhaust system according to claim 7 wherein said support means comprises a generally vertically extending support post mounted outwardly from a side wall of said crucible, said columnar duct being mounted upon said support post and extending generally longitudinally thereof, said means for flexibly coupling said charging hood means to said columnar duct comprising a pair of coaxial swivels lying in parallel planes extending generally transversely of said support post and a duct section supported between said swivels, said charging hood means being rigidly attached to said duct section for swivelling movement between its storage and use positions upon said duct section.

9. A fumes exhaust system according to claim 7 wherein said opening in said charging hood means top has generally circular horizontal cross sections and vertical cross sections of said charging hood means extending radially from the center of said opening are generally triangular in shape providing a radially inwardly and downwardly facing surface, said means for providing air movement past said mouth including a plurality of apertures opening on said inwardly and downwardly facing surface and internally of said charging hood means for allowing fumes to pass into said charging hood means.

10. A fumes exhaust system according to claim 9 wherein said apertures are elongated slots extending downwardly and radially outwardly from said charging hood means top.

11. A fumes exhaust system according to claim 7 wherein said opening has a generally arcuate horizontal cross section, said charging hood means further defining an open sector for allowing a charging bucket to enter said opening horizontally through said open sector for charging said furnace.

12. A fumes exhaust system according to claim 7 and further comprising means for sensing the temperature of fumes captured by said first hood means, selectively operable damper means connected to said exhaust means, and means for operating said damper means, said operating means being connected to said temperature sensing means and responsive thereto for opening said damper means to admit air into said exhaust means when the temperature of said fumes captured by said first hood means exceeds a predetermined maximum temperature.

* * * * *

UNITED STATES PATENT OFFICE

CERTIFICATE OF CORRECTION

Patent No. 3,999,001 Dated December 21, 1976

Inventor(s) Robert C. Overmyer and Pramodh Nijhawan

It is certified that error appears in the above-identified patent and that said Letters Patent are hereby corrected as shown below:

Column 1, line 33, change "an" to -- and --.
Column 3, line 55, before "position" insert -- line --.
Column 5, line 36, "transaxially" is misspelled.
Column 5, line 67, change "54" to -- 154 --.
Column 11, line 66, after "from" insert -- said --.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*